US007712854B2

(12) United States Patent
Ou et al.

(10) Patent No.: US 7,712,854 B2
(45) Date of Patent: May 11, 2010

(54) PIEZOELECTRIC FLUID INJECTION DEVICES AND DRIVING VOLTAGE CALIBRATION METHODS THEREOF

(75) Inventors: Hsiang-Pei Ou, Taichung (TW); Chieh-Yi Huang, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 557 days.

(21) Appl. No.: 11/604,857

(22) Filed: Nov. 28, 2006

(65) Prior Publication Data

US 2007/0296771 A1 Dec. 27, 2007

(30) Foreign Application Priority Data

Jun. 27, 2006 (TW) ..... 95123123 A

(51) Int. Cl.
*B41J 29/38* (2006.01)
*B41J 2/045* (2006.01)

(52) U.S. Cl. ..... 347/9; 347/70

(58) Field of Classification Search ..... 347/9, 347/70

See application file for complete search history.

(56) References Cited

U.S. PATENT DOCUMENTS 6,286,922 B1 9/2001 Kondou
2002/0080202 A1* 6/2002 Sekiguchi ..... 347/10

FOREIGN PATENT DOCUMENTS

TW 528680 8/1990

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

A piezoelectric fluid injection device and a driving voltage calibration method thereof. The piezoelectric fluid injection device includes at least one inkjet printhead comprising a plurality of nozzles, at least one voltage control element connecting to the inkjet printhead, a controller connecting to the voltage control element, a reference capacitor connecting to an auxiliary voltage control element and the controller in parallel with the inkjet printhead.

15 Claims, 14 Drawing Sheets

PIEZOELECTRIC FLUID INJECTION DEVICES AND DRIVING VOLTAGE CALIBRATION METHODS THEREOF

BACKGROUND OF THE INVENTION

1. Field of the Invention

The invention relates to a micro-fluid injection device, and in particular to a piezoelectric fluid injection device and a driving voltage calibration method thereof.

2. Description of the Related Art

Recently, fluid injection has been widely utilized in various devices such as inkjet printers and the like. As micro-system engineering increasingly develops, such devices can be further applied in other fields, for example, fuel injection, cell sorting, drug delivery, print lithography, and micro-jet propulsion systems. Inkjet applications generally utilize continuous or drop-on-demand supply.

Conventional fluid injection devices also comprise thermal bubble and piezoelectric diaphragm drive types.

A conventional control circuit of a piezoelectric inkjet printhead is shown in FIG. 1. A piezoelectric inkjet printhead 10 includes a plurality of nozzles 1~X such as 1~128. Each nozzle's equivalent circuit represents parallel equivalent capacitors $C_{L1}$~$C_{LX}$. Each nozzle is driven by a driving cell 20. Conventionally, the nozzles of printhead are driven by a fixed driving voltage, such as 100V. However, impedance variations among nozzles are produced due to operational variations in piezoelectric diaphragm process or ageing, resulting in formation of various droplet volumes, or even, for some nozzles, no droplets being ejected therefore when the fixed driving voltage is applied, seriously affecting utilization efficiency of the inkjet printhead.

Additionally, variations in fluid pressure resulting from alternation of fluid resistance or material property around nozzles may also cause such drawbacks.

U.S. Pat. No. 6,286,922 discloses a method of controlling a driving voltage of a piezoelectric inkjet printhead and a feedback procedure. An output driving voltage from a control system is switched via an analog/digital converter and fed back. The feedback voltage is then determined by comparison with an actual required driving voltage by the control system and modified.

U.S. Pat. No. 6,286,922 discloses a driving circuit and a control system of a piezoelectric inkjet printhead, capable of controlling ejected droplet volumes and providing preferred printing quality.

BRIEF SUMMARY OF THE INVENTION

The invention provides a piezoelectric fluid injection device comprising at least one inkjet printhead comprising a plurality of nozzles, at least one voltage control element connecting to the inkjet printhead, a controller connecting to the voltage control element, a reference capacitor connecting to an auxiliary voltage control element and the controller in parallel with the inkjet printhead.

Each nozzle of the inkjet printhead is independently controlled. A driving voltage and its waveform are modified by a feedback circuit, achieving the optimal utilization efficiency of the inkjet printhead.

The invention also provides a method of calibrating a driving voltage of a piezoelectric fluid injection device, comprising the following steps. A piezoelectric fluid injection device comprising at least one nozzle and a reference capacitor is provided. The nozzle corresponds to a nozzle driving voltage. The reference capacitor corresponds to a reference driving voltage. The nozzle driving voltage is compared with the reference driving voltage. If the nozzle driving voltage and the reference driving voltage are substantially distinct, the nozzle driving voltage is modified to substantially correspond to the reference driving voltage. The modified nozzle driving voltage is stored in a memory cell and acts as a reference for subsequent calibration.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawing, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

The invention provides an independent driving circuit for each nozzle to output various driving voltages, overcoming the issue of impedance variations thereamong. In accordance with a preferred embodiment of the invention, a feedback circuit is provided to detect the setted voltage and the output voltage (driving voltage) of each nozzle and modify the output voltage (driving voltage) to correspond to the setted voltage. Additionally, the waveforms of the output voltages (driving voltages) of nozzles, inconsistent due to impedance variations, are synchronized by a waveform control procedure, thus optimizing inkjet time of each nozzle.

Figure 1:
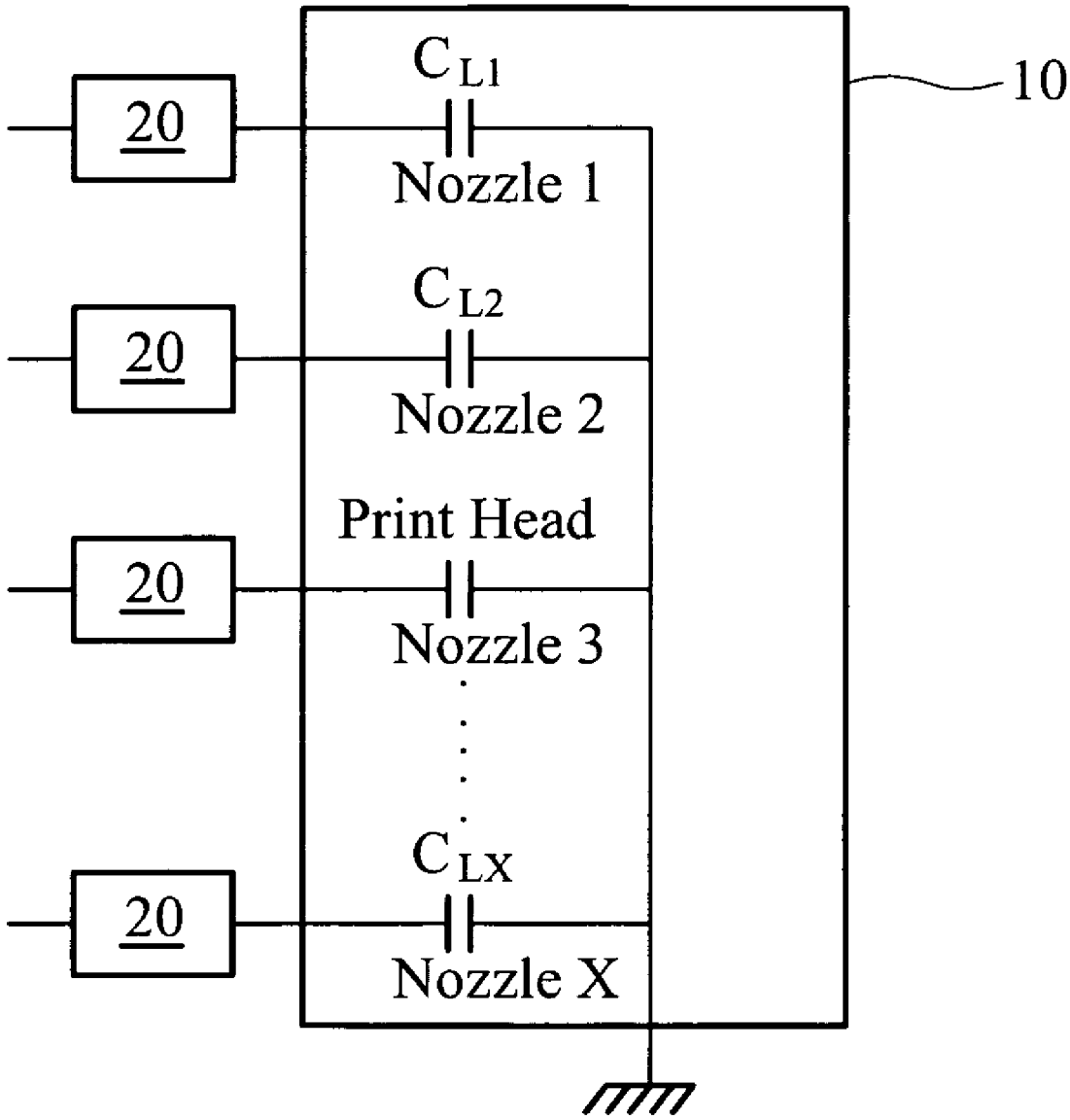
FIG. 1 (PRIOR ART)
FIG. 1 shows a conventional control circuit of a piezoelectric inkjet printhead.

The invention provides a method of calibrating a driving voltage of a piezoelectric fluid injection device. A piezoelectric inkjet printhead is placed on a printing platform. Each nozzle thereof represents an equivalent capacitive load. FIG. 1 discloses an equivalent circuit of each nozzle of a piezoelectric fluid injection device. The capacitive loads (impedances) among nozzles are distinct due to operational variations in the print head production process. When a fixed driving voltage is applied thereto, the actuations of nozzles may be inconsistent, deteriorating printing quality.

Additionally, when printing is performed, in accordance with input data, only a portion of the nozzles may be simultaneously actuated such that the sum of impedances is altered. Thus, the stability of driving cannot be maintained when the fixed driving voltage is applied. The invention provides an independent driving circuit for each nozzle to avoid the unfixed parallel capacitive loads.

Figure 2A:
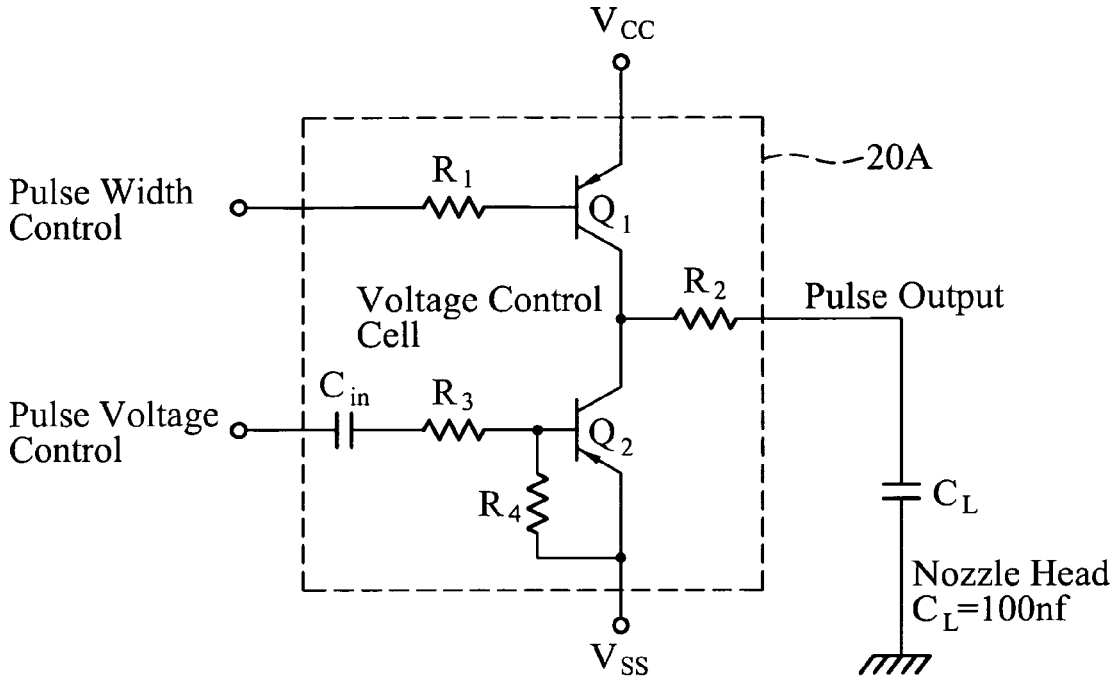
FIG. 2A shows each driving cell of a negative-voltage piezoelectric nozzle control circuit.
Figure 2B:
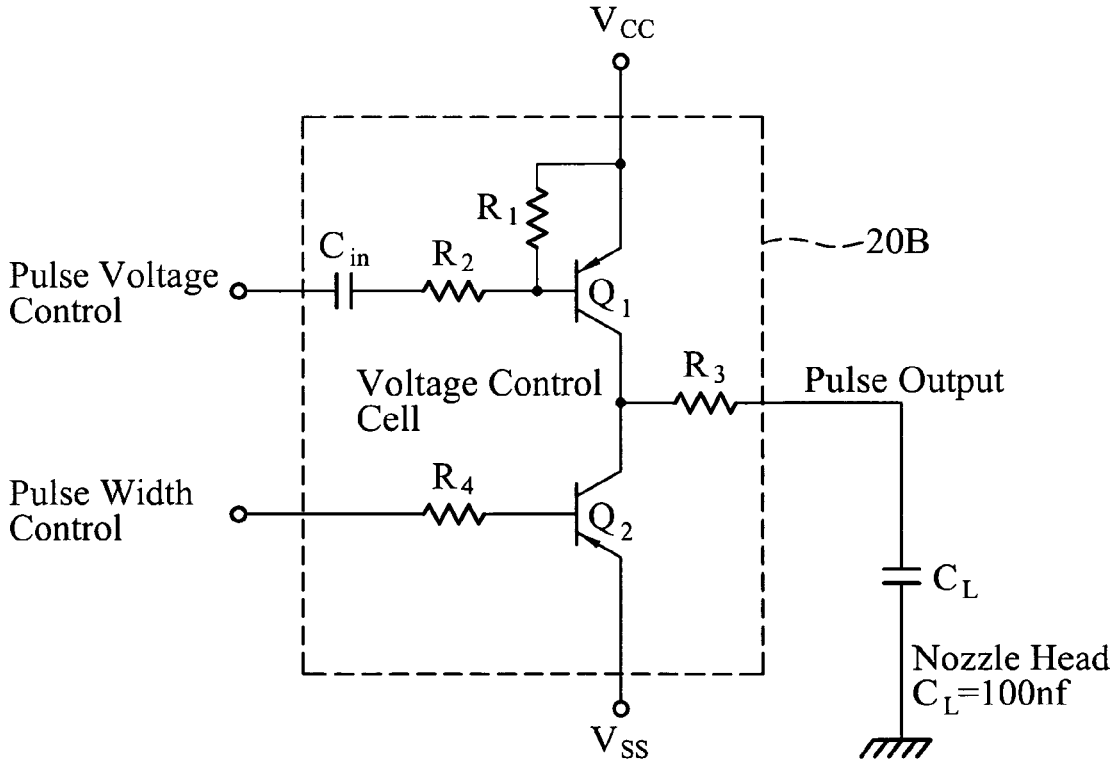
FIG. 2B shows each driving cell of a positive-voltage piezoelectric nozzle control circuit.

A piezoelectric nozzle driving voltage control element includes negative-voltage circuit driving cells and positive-voltage ones which are shown individually in FIG. 2A and FIG. 2B. When each nozzle of print head is independently controlled, proper driving voltage amplitude, waveform width, and circuit are required to control the piezoelectric actuation. A simple negative-voltage driving cell circuit 20A is disposed near the inkjet printhead to reduce control signal loss during transmission. In FIG. 2A, Vcc represents a standard logic level voltage and Vss represents a high negative-voltage. When the pulse width control signal is at a low level, a capacitor $C_L$ corresponding to a nozzle is charged by a transistor $Q_1$. As driving begins, the pulse width control signal is at a high level and the transistor $Q_1$ is turned off, the pulse voltage control signal is at a low level and the transistor $Q_2$ is turned off, too. Next, the pulse voltage control signal is at a high level and the transistor $Q_2$ is turned on. Meanwhile, the equivalent capacitor $C_L$ is charged to the high negative-voltage until the pulse voltage control signal reaches a low level ($Q_2$ turn off simultaneously). Finally, the equivalent capacitor $C_L$ achieves a terminal negative-voltage level. Specifically, when the pulse voltage control signal keeps at a high level, the equivalent capacitor $C_L$ is continuously charged to the saturation negative-voltage. Thus, the terminal voltage of the equivalent capacitor $C_L$ is determined by controlling the retention time of the pulse voltage control signal at a high level state.

The positive-voltage piezoelectric nozzle control circuit driving cells are shown in FIG. 2B. A positive-voltage driving cell 20B is provided that Vcc represents a high positive-voltage and Vss represents a ground. Before driving, the pulse voltage control signal is at a high level and the pulse width control signal is at a low level, thus the transistor $Q_1$ and $Q_2$ are turned off. As driving commences, the pulse voltage control signal is at a low level and a transistor $Q_1$ is turned on. Meanwhile, the equivalent capacitor $C_L$ is charged until the pulse voltage control signal is promoted to a high level ($Q_1$ is turned off simultaneously). Thus, the equivalent capacitor $C_L$ achieves a terminal positive-voltage level. When the pulse voltage control signal continuously maintains a low level, the equivalent capacitor $C_L$ is continuously charged and finally promoted to the saturation positive-voltage.

The invention provides a driving circuit and a control system of a piezoelectric inkjet printhead. Each nozzle ejection behavior will be tune to consistency and uniform, when the independent addressable waveform nozzle control driver which controls includes driving voltage and waveform thereof are modified by a feedback circuit, achieving the optimal utilization efficiency of nozzles. The piezoelectric fluid injection device comprises at least one inkjet printhead comprising a plurality of nozzles, at least one voltage control element connecting to the inkjet printhead, a controller connecting to the voltage control element, a reference capacitor connecting to an auxiliary voltage control element and the controller in parallel with the inkjet printhead.

Figure 3:
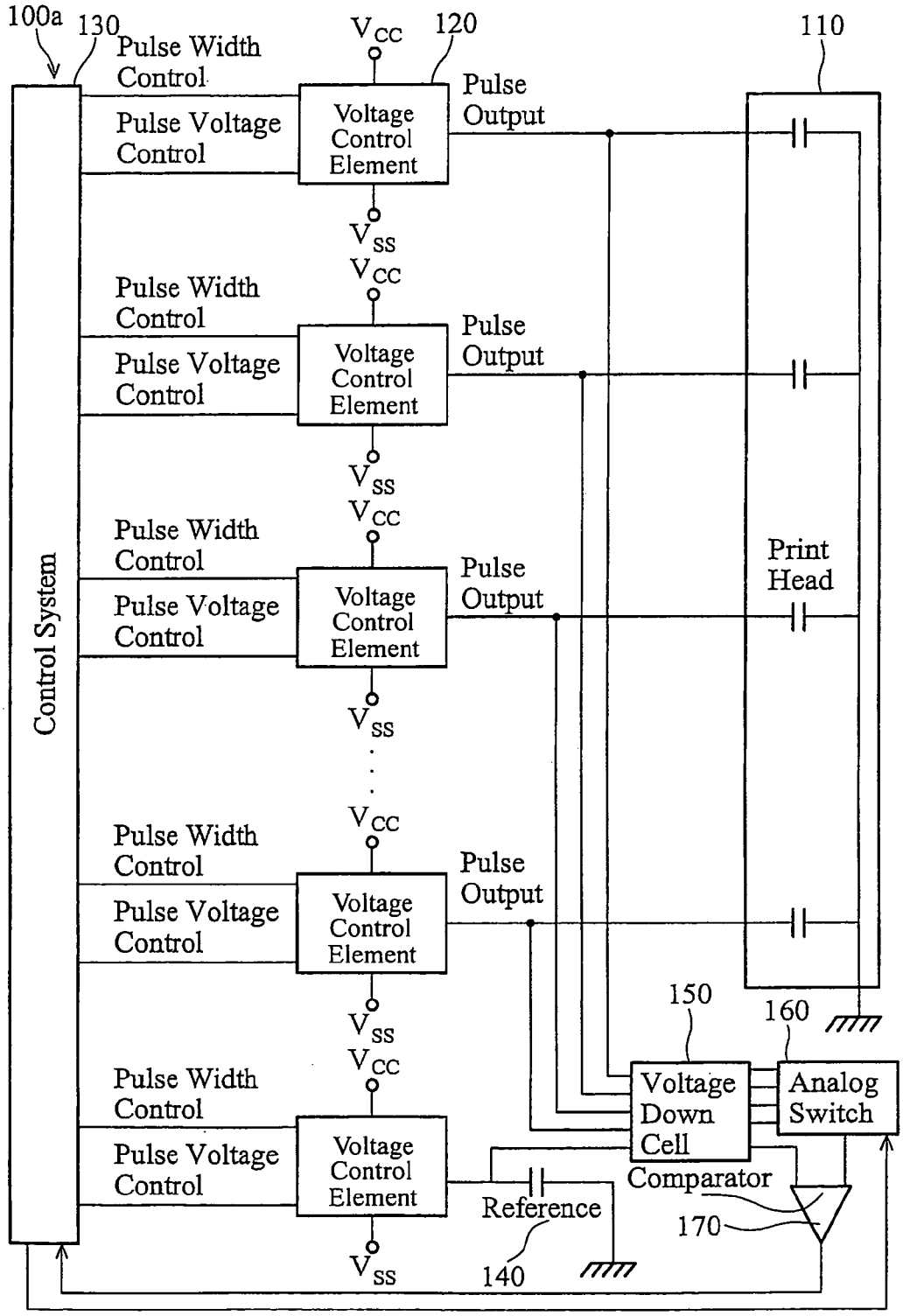
FIG. 3 shows a control system comprising a feedback circuit of a piezoelectric inkjet printhead in accordance with the first embodiment of the invention.

In accordance with the first embodiment of the invention, a control system comprising a feedback circuit of a piezoelectric inkjet printhead is shown in FIG. 3. A control system 100*a* of a piezoelectric inkjet printhead comprises a control system 130, a plurality of voltage control cells 120, a piezoelectric inkjet printhead 110, a voltage down cell 150, an analog switch 160, a comparator 170, and a reference capacitor $C_L$ 140. After placing the inkjet printhead into a printing system, starting the printing system, or using the inkjet printhead for a period of time, each nozzle voltage (driving voltage) is calibrated to correspond to the set value as follows. After setting the voltage, a reference voltage is produced from a reference capacitor $C_L$ 140 and dropped to a proper voltage level. A nozzle voltage (driving voltage) is dropped by a voltage down cell 150 and switched via an analog switch 160 to output a voltage signal into a comparator 170 to compare with the reference voltage. The nozzle voltage (driving voltage) is then continuously modified by a controller until corresponding to the reference voltage. The foregoing steps are repeated until calibration of all nozzles is completed. The calibrated voltage parameters are stored in a data storing cell of the controller and used when printing is performed.

Figure 4:
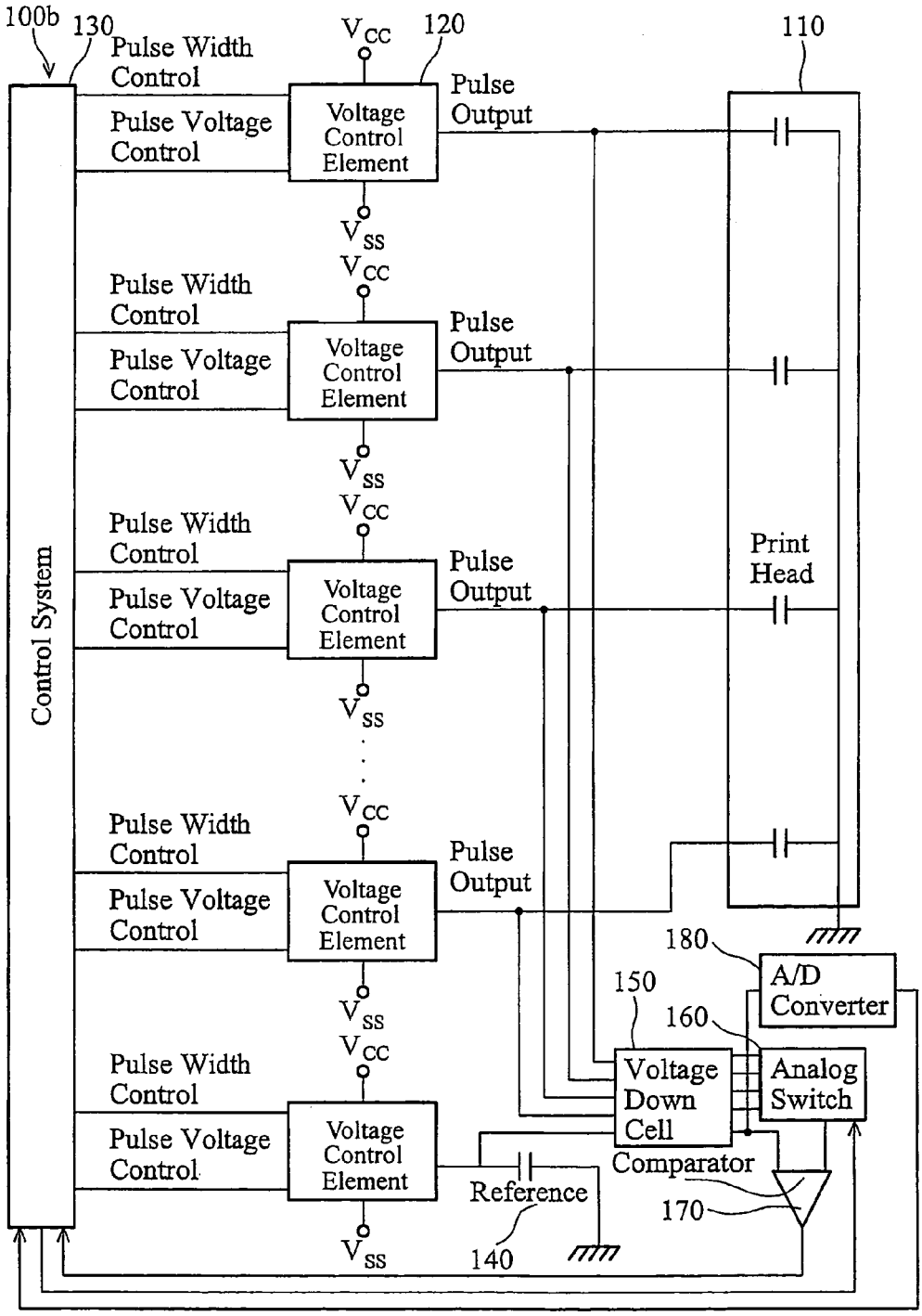
FIG. 4 shows a control system comprising a feedback circuit of a piezoelectric inkjet printhead in accordance with the second embodiment of the invention.

In accordance with the second embodiment of the invention, a control system comprising a feedback circuit of a piezoelectric inkjet printhead is shown in FIG. 4. An analog/digital converter 180 is added. Compared to the control system of FIG. 3 in which a relative reference voltage is obtained, a real reference voltage is obtained by the analog/digital converter 180. A control system 100*b* of a piezoelectric inkjet printhead comprises a control system 130, a plurality of voltage control cells 120, a piezoelectric inkjet printhead 110, a voltage down cell 150, an analog switch 160, a comparator 170, a reference capacitor $C_L$ 140, and an analog/digital converter 180. After placing the inkjet printhead into a printing system, starting the printing system, or using the inkjet printhead for a period of time, each nozzle voltage (driving voltage) is calibrated to correspond to the set value as follows. After setting the voltage, a reference voltage is produced from a reference capacitor $C_L$ 140 and generated to a proper voltage level. The reference voltage is then switched via the analog/digital converter 180 and fed back and modified to correspond to the setting value. A nozzle feedback voltage is generated by a voltage down cell 150 and switched via an analog switch 160 to output a feedback voltage signal into a comparator 170 to compare with the reference voltage. The nozzle voltage (driving voltage) is then continuously modified by a controller until corresponding to the reference voltage. The foregoing steps are repeated until calibration of all nozzles is completed. The calibrated voltage parameters are stored in a data storing cell of the controller and used when printing is performed.

Figure 5:
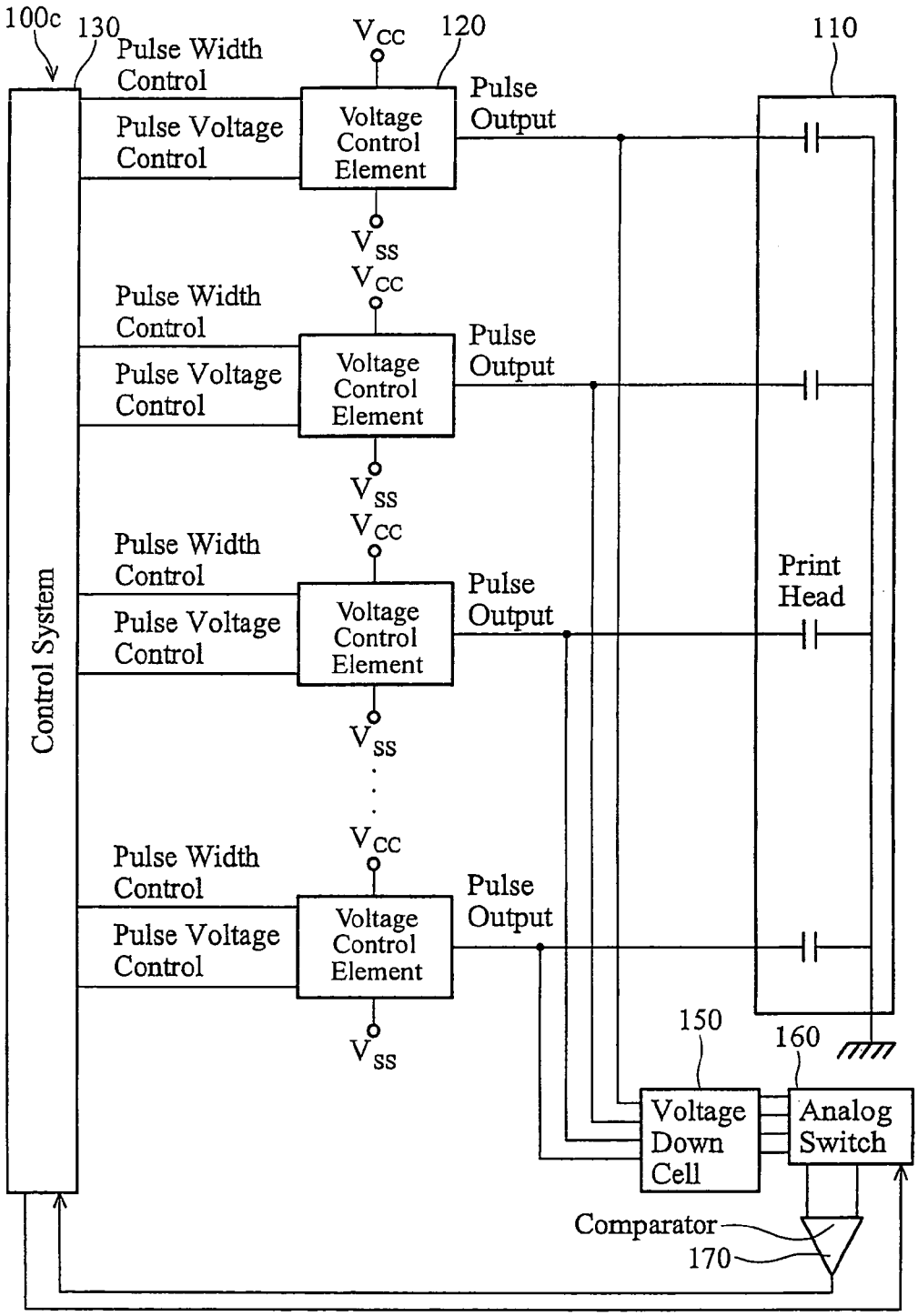
FIG. 5 shows a control system comprising a feedback circuit of a piezoelectric inkjet printhead in accordance with the third embodiment of the invention.

In accordance with the third embodiment of the invention, a control system comprising a feedback circuit of a piezoelectric inkjet printhead is shown in FIG. 5. Compared to the control system of FIG. 3, the reference capacitor $C_L$ is replaced by one of the nozzles (reference nozzle) of the inkjet printhead. The control system of FIG. 5 saves a reference capacitor $C_L$ circuit. More reserved nozzles, however, are required for preventing the malfunction of the reference nozzle.

Figure 6:
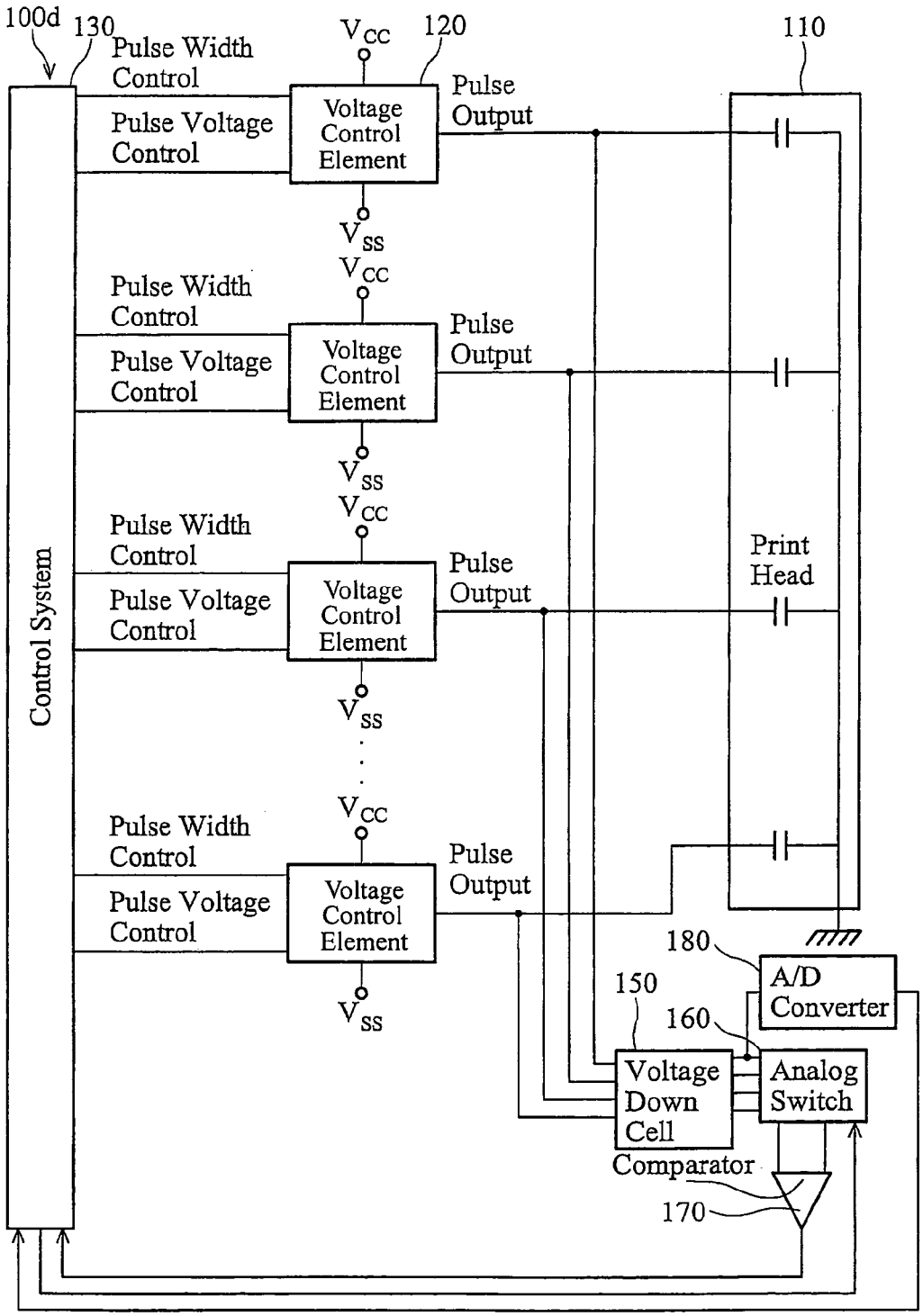
FIG. 6 shows a control system comprising a feedback circuit of a piezoelectric inkjet printhead in accordance with the fourth embodiment of the invention.

In accordance with the fourth embodiment of the invention, a control system comprising a feedback circuit of a piezoelectric inkjet printhead is shown in FIG. 6. Compared to the control system of FIG. 5, an analog/digital converter 180 is added, thereby obtaining an accurate output voltage. Similarly, more reserved nozzles are required for preventing the malfunction of the reference nozzle.

Figure 7:
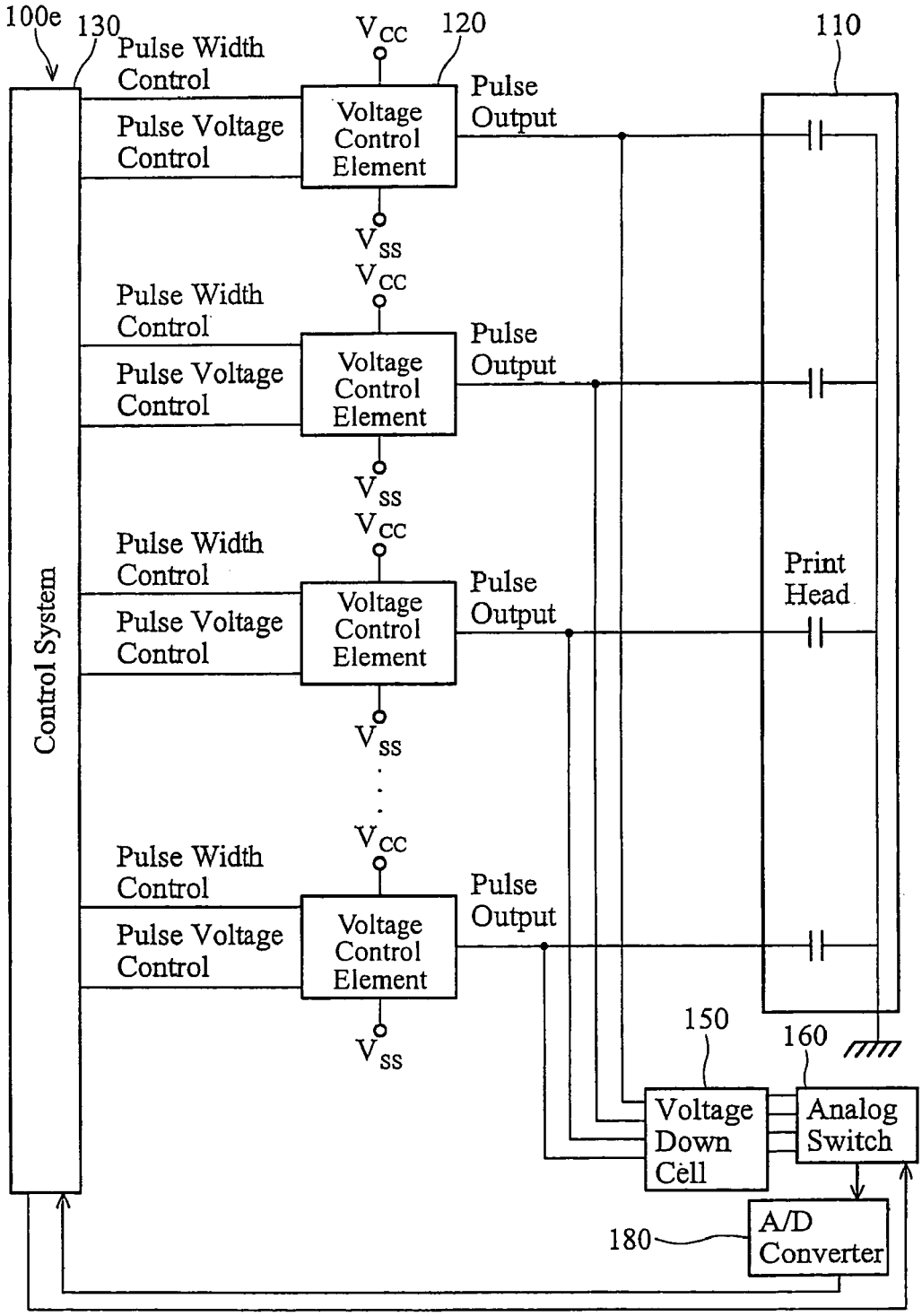
FIG. 7 shows a control system comprising a feedback circuit of a piezoelectric inkjet printhead in accordance with the fifth embodiment of the invention.

In accordance with the fifth embodiment of the invention, a control system comprising a feedback circuit of a piezoelectric inkjet printhead is shown in FIG. 7. Compared to the control systems of FIGS. 3~6, the comparator 170 is removed, thereby accurately controlling each nozzle voltage (driving voltage), however, prolonging the calibration time.

The invention provides a method of calibrating a driving voltage amplitude and a driving waveform of a piezoelectric inkjet printhead, overcoming the issue of impedance variations among nozzles. A procedure of voltage modification is provided which is calibrated after placing the inkjet printhead into a printing system, using the inkjet printhead for a period of time, or setting an action voltage. After the voltage calibration, the driving waveforms are calibrated to achieve uniformity. The invention provides two waveform calibration methods comprising aligning the rising curve central point of each driving waveform and aligning the terminal voltage of each driving waveform to improve the uniformity of droplets.

Figure 8:
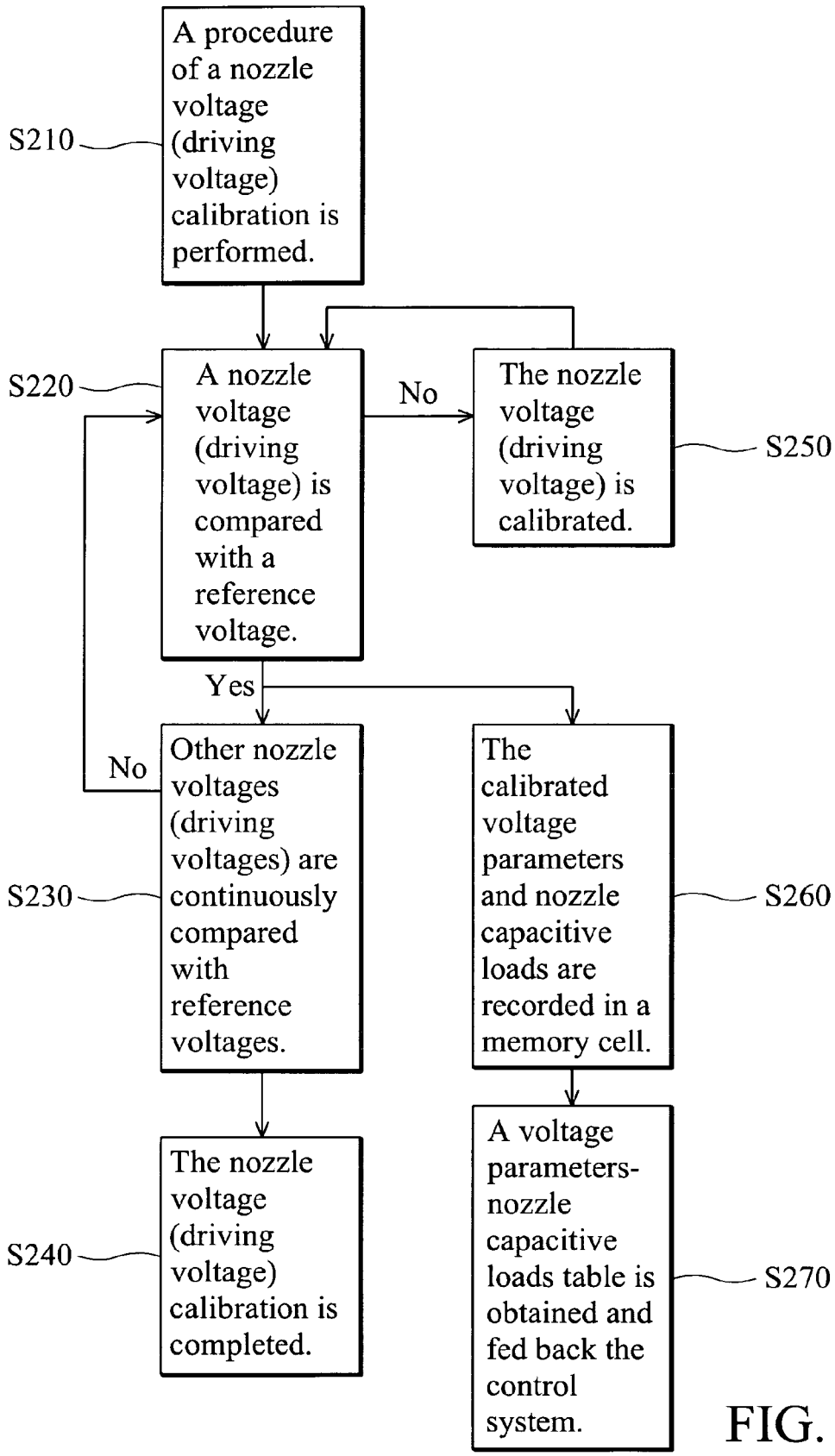
FIG. 8 discloses a method of calibrating a driving voltage of a piezoelectric inkjet printhead in accordance with one embodiment of the invention.

In accordance with one embodiment of the invention, a method of calibrating a driving voltage of a piezoelectric inkjet printhead is shown in FIG. 8. After placing a new inkjet printhead into a printing system, using the inkjet printhead for a period of time, or setting a driving voltage, nozzle voltage (driving voltage) calibration is performed S210. Next, a nozzle voltage (driving voltage) is compared with a reference voltage S220. The nozzle voltage (driving voltage) is then calibrated until corresponding to the reference voltage S250. Next, other nozzle voltages (driving voltages) are continuously compared with reference voltages S230 until the nozzle voltage (driving voltage) calibration is completed S240. Additionally, the calibrated voltage parameters and nozzle capacitive loads are recorded in a memory cell S260. A voltage parameters-nozzle capacitive loads table is obtained and fed back the control system S270.

Figure 9:
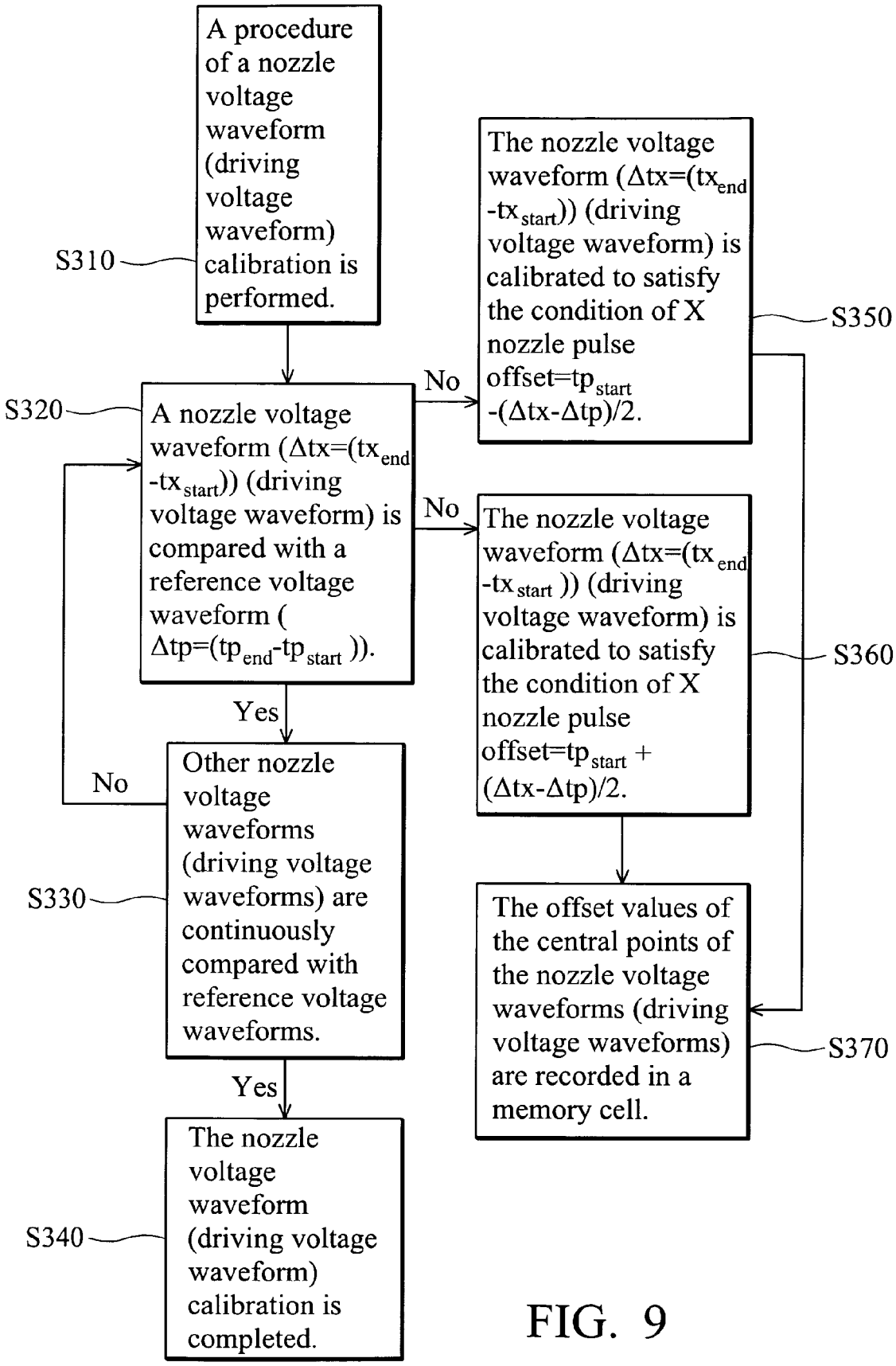
FIG. 9 discloses a method of calibrating a driving voltage of a piezoelectric inkjet printhead in accordance with the sixth embodiment of the invention.

In accordance with sixth embodiment of the invention, a method of calibrating a driving voltage of a piezoelectric inkjet printhead is shown in FIG. 9. After placing a new piezoelectric inkjet printhead into a printing system, using the piezoelectric inkjet printhead for a period of time, or setting a driving voltage, nozzle voltage waveform (driving voltage waveform) calibration is performed S310. Next, a nozzle voltage waveform ($\Delta tx=(tx_{end}-tx_{start})$) (driving voltage waveform) is compared with a reference voltage waveform ($\Delta tp=(tp_{end}-tp_{start})$) S320. The nozzle voltage waveform ($\Delta tx=(tx_{end}-tx_{start})$) (driving voltage waveform) is then calibrated until corresponding to the reference voltage waveform ($\Delta tp=(tp_{end}-tp_{start})$) S350 and S360, satisfying the two conditions including X nozzle pulse offset=$tp_{start}-(\Delta tx-\Delta tp)/2$ or X nozzle pulse offset=$tp_{start}+(\Delta tx-\Delta tp)/2$. Next, other nozzle voltage waveforms (driving voltage waveforms) are continuously compared with reference voltage waveforms S330 until the nozzle voltage waveform (driving voltage waveform) calibration is completed S340. Additionally, the offset values of the rising curve central points of the nozzle voltage waveforms (driving voltage waveforms) are recorded in a memory cell S370.

The widths of different nozzle voltage waveforms (driving voltage waveforms) are distinct due to variations in impedance among nozzles. The invention provides a calibration method to align the rising curve central points of different nozzle voltage waveforms (driving voltage waveforms), unifying injection behavior at nozzles. The time ($\Delta tp$) of the reference voltage waveform ($\Delta tp=(tp_{end}-tp_{start})$) is compared with the time ($\Delta tx$) of the nozzle voltage waveform (driving voltage waveform) ($\Delta tx=(tx_{end}-tx_{start})$). If $\Delta tx$ is larger than $\Delta tp$ or the inverse, the rising curve central points thereof are then aligned. After alignment, such relevant waveform parameters are stored.

In the invention, the start point of the reference voltage waveform is a basis of calibration, but is not limited thereto.

Figure 10A:
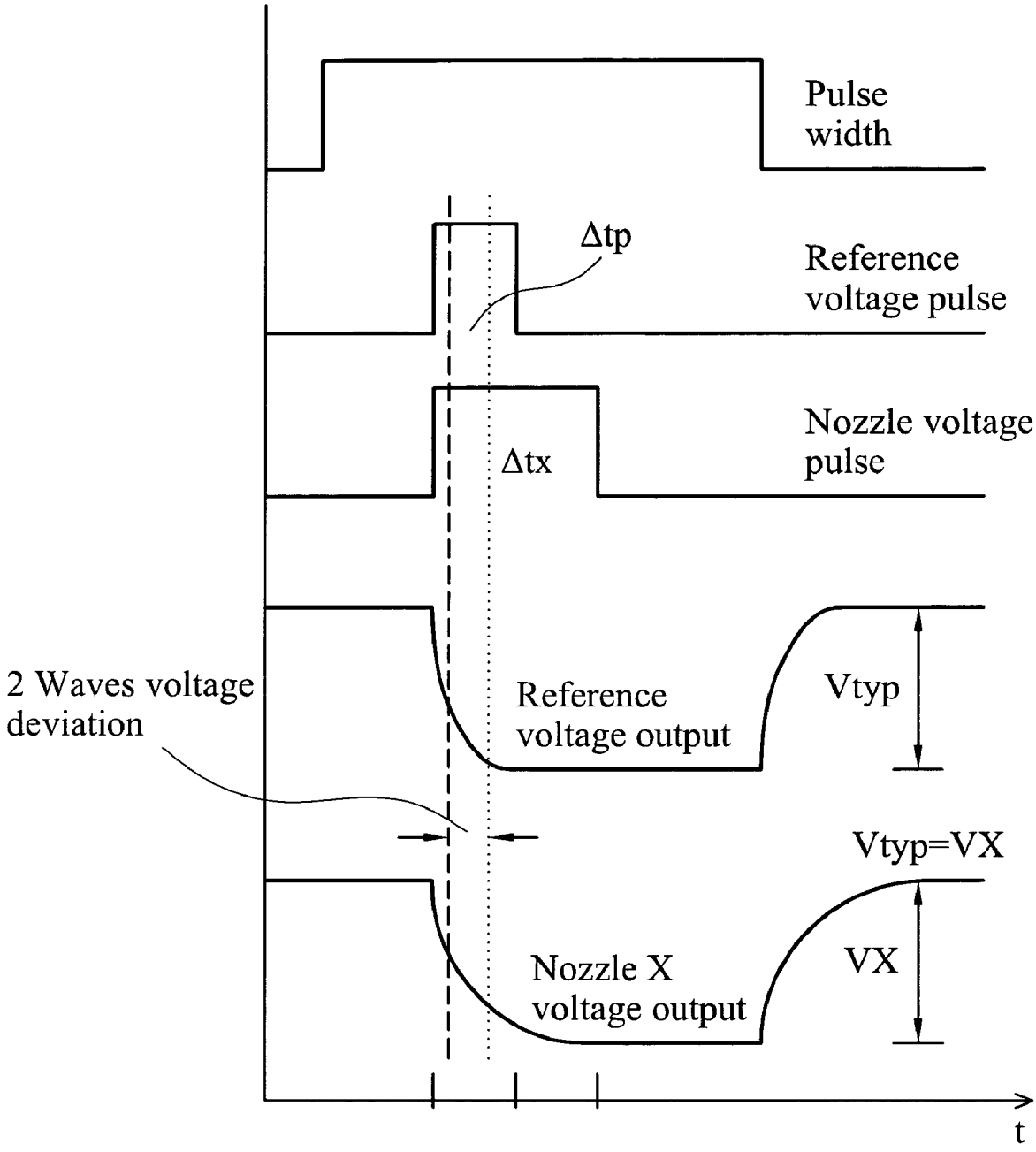
FIGS. 10A~10B show the waveforms of the reference voltage and the nozzle voltage (driving voltage) of the sixth embodiment of the invention.
Figure 10B:
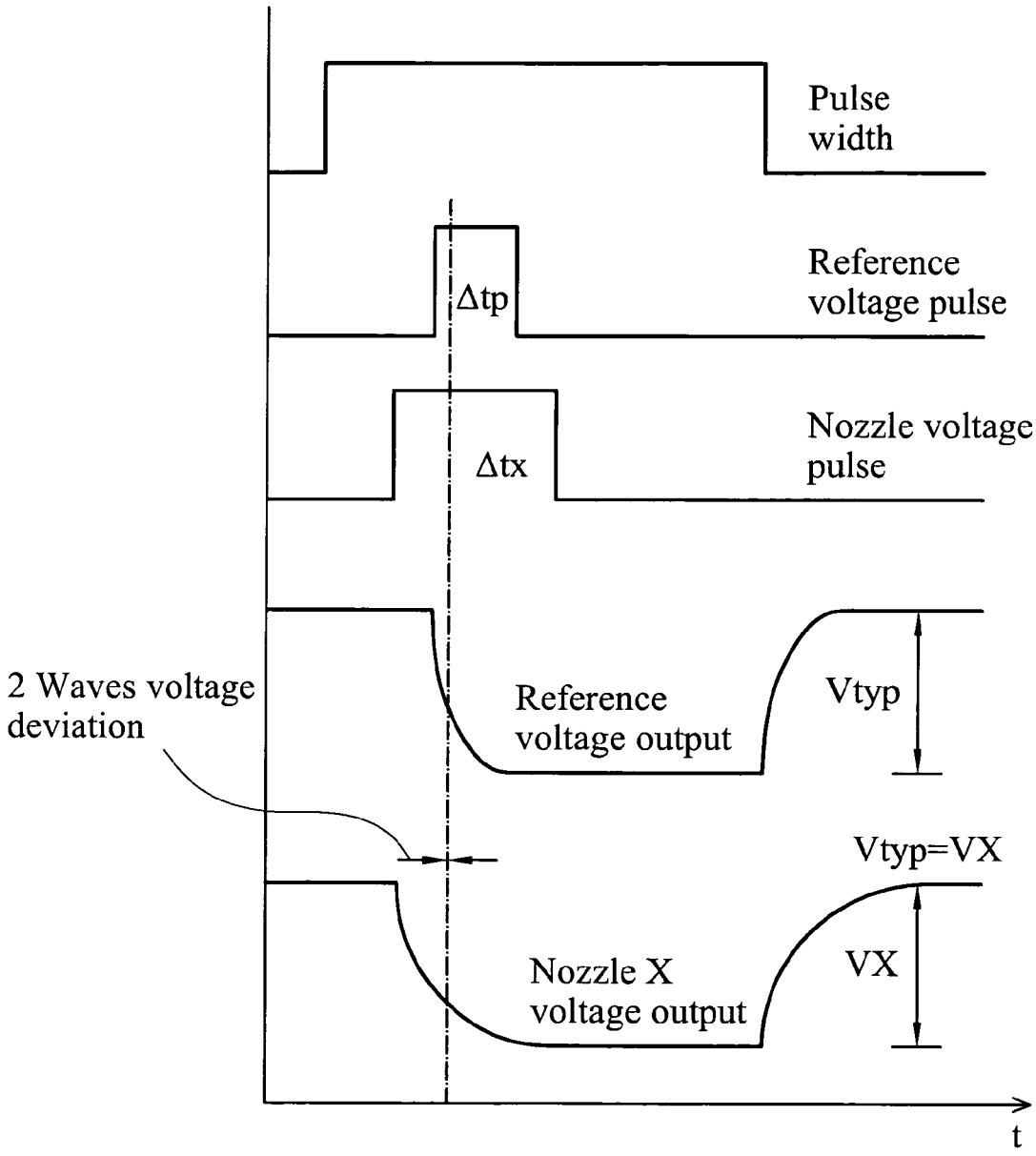

The waveforms of the reference voltage and the nozzle voltage (driving voltage) of the sixth embodiment are shown in FIGS. 10A and 10B. The voltage waveforms of FIG. 10A are not yet calibrated. In FIG. 10A, although the start points are the same, the end points are distinct due to variations in impedance. However, after the rising curve central point calibration, no deviation occurs between the two voltage waveforms as shown in FIG. 10B, unifying injection behavior at nozzles.

Figure 11:
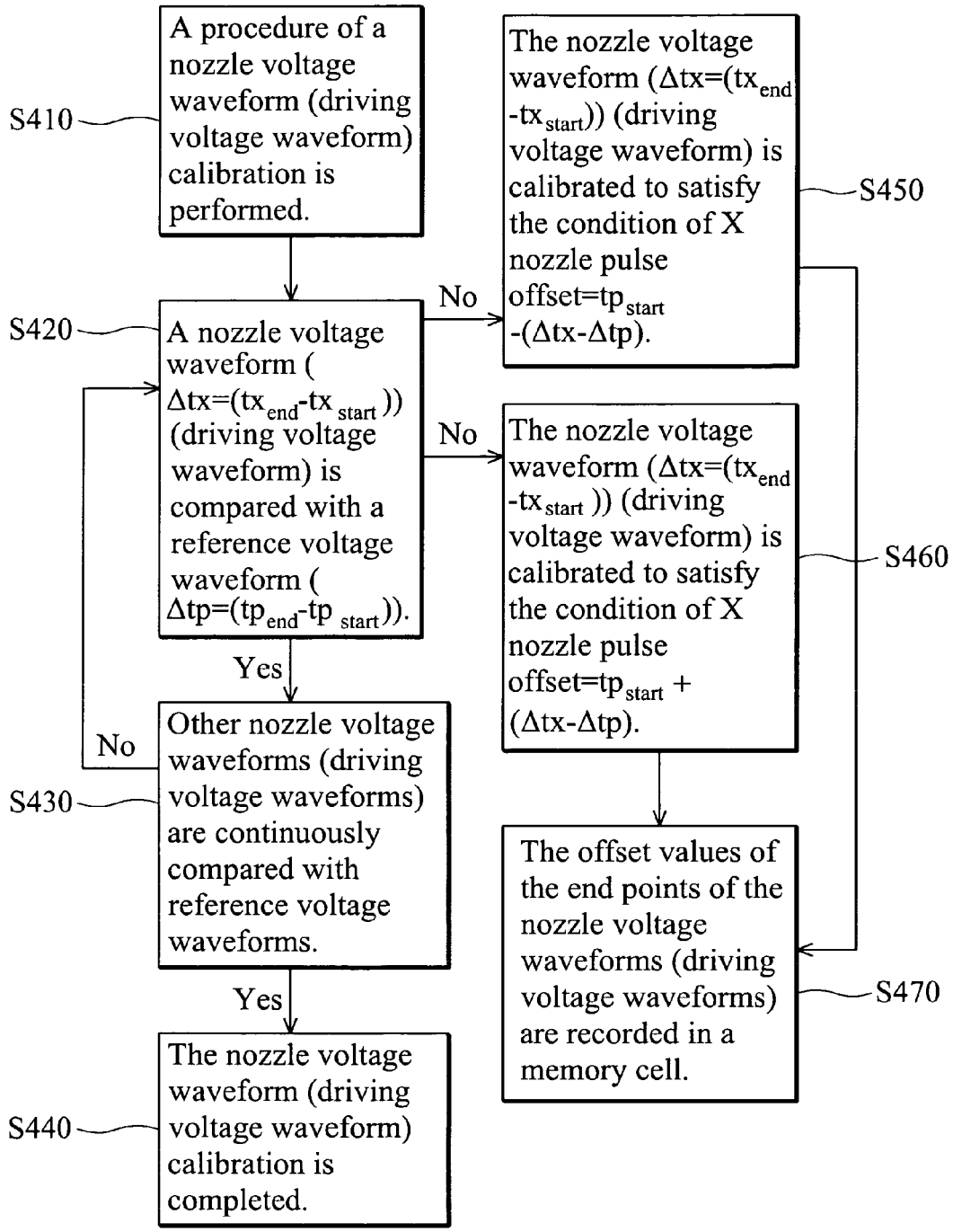
FIG. 11 discloses a method of calibrating a driving voltage of a piezoelectric inkjet printhead in accordance with the seventh embodiment of the invention.

In accordance with seventh embodiment of the invention, a method of calibrating a driving voltage of a piezoelectric inkjet printhead is shown in FIG. 11. After placing a new piezoelectric inkjet printhead into a printing system, using the piezoelectric inkjet printhead for a period of time, or setting a driving voltage, nozzle voltage waveform (driving voltage waveform) calibration is performed S410. Next, a nozzle voltage waveform ($\Delta tx=(tx_{end}-tx_{start})$) (driving voltage waveform) is compared with a reference voltage waveform ($\Delta tp=(tp_{end}-tp_{start})$) S420. The nozzle voltage waveform ($\Delta tx=(tx_{end}-tx_{start})$) (driving voltage waveform) is then calibrated until corresponding to the reference voltage waveform ($\Delta tp=(tp_{end}-tp_{start})$) S450 and S460, satisfying the two conditions including X nozzle pulse offset=$tp_{start}-(\Delta tx-\Delta tp)$ or X nozzle pulse offset=$tp_{start}+(\Delta tx-\Delta tp)$. Next, other nozzle voltage waveforms (driving voltage waveforms) are continuously compared with reference voltage waveforms S430 until the nozzle voltage waveform (driving voltage waveform) calibration is completed S440. Additionally, the offset values of the end points of the nozzle voltage waveforms (driving voltage waveforms) are recorded in a memory cell S470.

The widths of different nozzle voltage waveforms (driving voltage waveforms) are distinct due to variations in impedance among nozzles. The invention provides a calibration method to align the end points of different nozzle voltage waveforms (driving voltage waveforms). The time ($\Delta tp$) of the reference voltage waveform ($\Delta tp=(tp_{end}-tp_{start})$) is compared with the time ($\Delta tx$) of the nozzle voltage waveform (driving voltage waveform) ($\Delta tx=(tx_{end}-tx_{start})$). If $\Delta tx$ is larger than $\Delta tp$ or the contrary, the end points thereof are then aligned. After alignment, such relevant waveform parameters are stored.

Figure 12A:
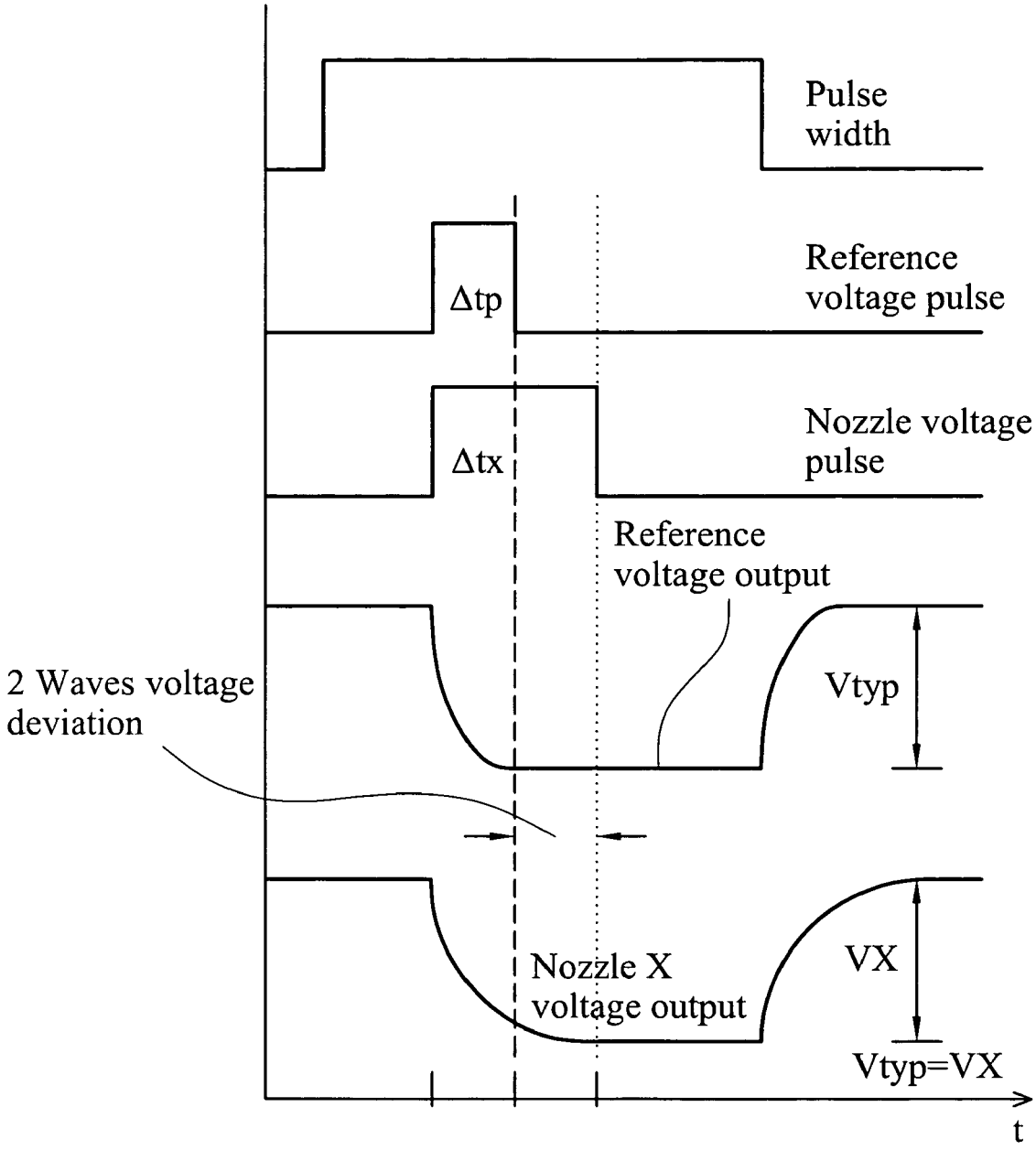
FIGS. 12A~12B show the waveforms of the reference voltage and the nozzle voltage (driving voltage) of the seventh embodiment of the invention.
Figure 12B:
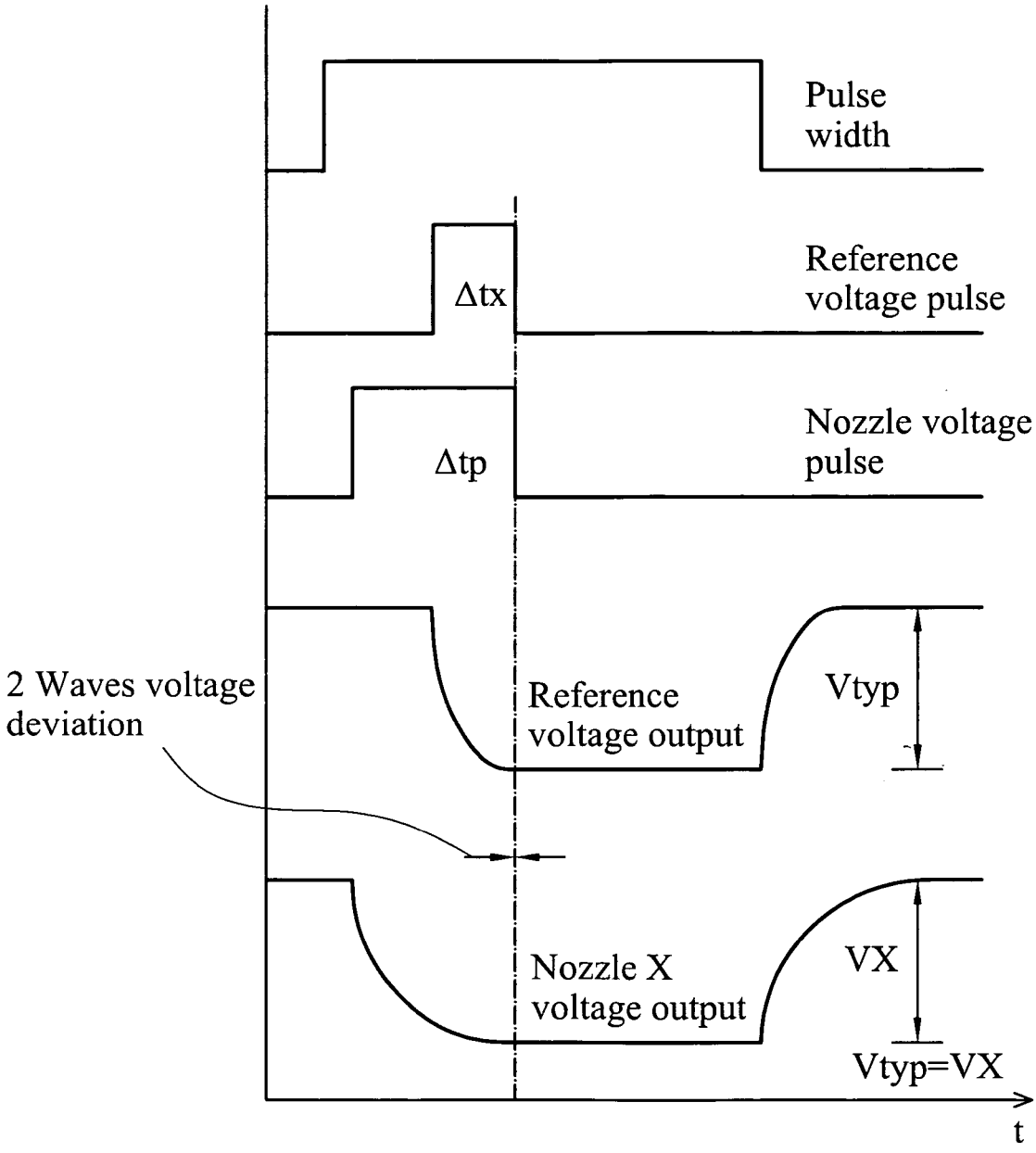

The waveforms of the reference voltage and the nozzle voltage (driving voltage) of the seventh embodiment are shown in FIGS. 12A and 12B. The voltage waveforms of FIG. 12A are not yet calibrated. In FIG. 12A, although the start points are the same, the end points are distinct due to variations in impedance. However, after the end point calibration, no deviation occurs between the two voltage waveforms as shown in FIG. 12B, unifying injection behavior at nozzles.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A piezoelectric fluid injection device, comprising:

at least one inkjet printhead comprising a plurality of nozzles;

a first voltage control element connecting to the nozzle of the inkjet printhead;

a reference capacitor connecting to a second voltage control element;

a voltage down cell connecting to the first and second voltage control elements;

an analog switch connecting to the voltage down cell;

a comparator connecting to the analog switch; and a controller connecting to the first voltage control element, the second voltage control element, the analog switch and the comparator.

2. The piezoelectric fluid injection device as claimed in claim 1, wherein the voltage control element comprises a plurality of driving cells of a negative-voltage piezoelectric inkjet printhead or a positive-voltage piezoelectric inkjet printhead.

3. The piezoelectric fluid injection device as claimed in claim 1, further comprising an analog/digital converter connecting to the voltage down cell and the controller.

4. A method of calibrating a driving voltage of a piezoelectric fluid injection device, comprising:

providing a piezoelectric fluid injection device comprising;

providing at least one inkjet printhead comprising a plurality of nozzles;

providing a first voltage control element connecting to the nozzle of the inkjet printhead;

providing a reference capacitor corresponding to a reference driving voltage and connecting to a second voltage control element;

providing a voltage down cell connecting to the first and second voltage control elements;

providing an analog switch connecting to the voltage down cell;

providing a comparator connecting to the analog switch;

providing a controller connecting to the first voltage control element, the second voltage control element, the analog switch and the comparator;

comparing the nozzle driving voltage driving the nozzle and the reference driving voltage produced by the reference capacitor;

modifying the nozzle driving voltage to substantially correspond to the reference driving voltage if the nozzle driving voltage and the reference driving voltage are substantially distinct; and storing the modified nozzle driving voltage in a memory cell.

5. The method as claimed in claim 4, wherein the reference driving voltage comprises a reference voltage pulse, the nozzle driving voltage comprises a nozzle voltage pulse, and the edge central point of the nozzle voltage pulse is substantially aligned to the edge central point of the reference voltage pulse.

6. The method as claimed in claim 4, wherein the reference driving voltage comprises a reference voltage pulse, the nozzle driving voltage comprises a nozzle voltage pulse, and the start point of the nozzle voltage pulse is substantially aligned to the start point of the reference voltage pulse.

7. The method as claimed in claim 4, wherein the reference driving voltage comprises a reference voltage pulse, the nozzle driving voltage comprises a nozzle voltage pulse, and the end point of the nozzle voltage pulse is substantially aligned to the end point of the reference voltage pulse.

8. The method as claimed in claim 4, wherein the reference driving voltage comprises a reference voltage waveform, the nozzle driving voltage comprises a nozzle voltage waveform, and the edge central point of the nozzle voltage waveform is substantially aligned to the edge central point of the reference voltage waveform.

9. The method as claimed in claim 4, wherein the reference driving voltage comprises a reference voltage waveform, the nozzle driving voltage comprises a nozzle voltage waveform, and the start point of the nozzle voltage waveform is substantially aligned to the start point of the reference voltage waveform.

10. The method as claimed in claim 4, wherein the reference driving voltage comprises a reference voltage waveform, the nozzle driving voltage comprises a nozzle voltage waveform, and the end point of the nozzle voltage waveform is substantially aligned to the end point of the reference voltage waveform.

11. A piezoelectric fluid injection device, comprising:

at least one inkjet printhead comprising a plurality of nozzles;

at least one voltage control element connecting to the nozzle of the inkjet printhead;

a voltage down cell connecting to the voltage control element;

an analog switch connecting to the voltage down cell;

a comparator connecting to the analog switch; and a controller connecting to the voltage control element, the analog switch and the comparator.

12. The piezoelectric fluid injection device as claimed in claim 11, wherein the voltage control element comprises a plurality of driving cells of a negative-voltage piezoelectric inkjet printhead or a positive-voltage piezoelectric inkjet printhead.

13. The piezoelectric fluid injection device as claimed in claim 11, further comprising an analog/digital converter connecting to the voltage down cell and the controller.

14. A piezoelectric fluid injection device, comprising:

at least one inkjet printhead comprising a plurality of nozzles;

at least one voltage control element connecting to the nozzle of the inkjet printhead;

a voltage down cell connecting to the voltage control element;

an analog switch connecting to the voltage down cell;

an analog/digital converter connecting to the analog switch; and a controller connecting to the voltage control element, the analog switch and the analog/digital converter.

15. The piezoelectric fluid injection device as claimed in claim 14, wherein the voltage control element comprises a plurality of driving cells of a negative-voltage piezoelectric inkjet printhead or a positive-voltage piezoelectric inkjet printhead.

* * * * *